US008466838B2

(12) United States Patent
Adada et al.

(10) Patent No.: US 8,466,838 B2
(45) Date of Patent: Jun. 18, 2013

(54) CIRCULARLY POLARIZED MICROSTRIP ANTENNAS

(75) Inventors: Rami Adada, Jackson, MI (US); Hussain Al-Rizzo, Little Rock, AR (US)

(73) Assignee: Board of Trustees of the University of Arkansas, Little Rock, AR (US)

( * ) Notice: Subject to any disclaimer, the term of this patent is extended or adjusted under 35 U.S.C. 154(b) by 260 days.

(21) Appl. No.: 12/754,172

(22) Filed: Apr. 5, 2010

(65) Prior Publication Data

US 2011/0025571 A1 Feb. 3, 2011

Related U.S. Application Data

(60) Provisional application No. 61/211,848, filed on Apr. 3, 2009, provisional application No. 61/214,681, filed on Apr. 27, 2009.

(51) Int. Cl.
*H01Q 1/38* (2006.01)

(52) U.S. Cl.
USPC ..... 343/700 MS

(58) Field of Classification Search
USPC ..... 29/600; 343/700 MS, 770
See application file for complete search history.

(56) References Cited

U.S. PATENT DOCUMENTS

| | | | | |
|---|---|---|---|---|
| 4,125,839 | A | 11/1978 | Kaloi | |
| 5,216,430 | A * | 6/1993 | Rahm et al. | 343/700 MS |
| 5,241,321 | A | 8/1993 | Tsao | |
| 5,410,323 | A * | 4/1995 | Kuroda | 343/700 MS |
| 6,507,320 | B2 | 1/2003 | Von Stein et al. | |
| 6,674,410 | B1 | 1/2004 | Davidovitz | |
| 2005/0162318 | A1 | 7/2005 | Higasa | |
| 2010/0019976 | A1 * | 1/2010 | Sakiyama et al. | 343/700 MS |

FOREIGN PATENT DOCUMENTS

| | | | |
|---|---|---|---|
| GB | 2202379 | A | 9/1988 |
| WO | 2006071140 | A1 | 7/2006 |

OTHER PUBLICATIONS

Lei Zhu; Boon Chai Tan; Siang Juay Quek; , "Miniaturized dual-mode bandpass filter using inductively loaded cross-slotted patch resonator," Microwave and Wireless Components Letters, IEEE , vol. 15, No. 1, pp. 22-24, Jan. 2005.*

* cited by examiner

*Primary Examiner* — Michael C Wimer
*Assistant Examiner* — Amal Patel
(74) *Attorney, Agent, or Firm* — Morris, Manning & Martin, LLP; Tim Tingkang Xia, Esq.

(57) ABSTRACT

The present invention in one aspect relates to a circularly polarized antenna having a conductive ground layer, a conductive patch and a dielectric substrate formed between the conductive ground layer and the conductive patch. The conductive patch formed in a square shape with four equal sides and has four square slots with each formed in the central portion of each side, and two rectangular slots orthogonally formed in the central area of the square such that one rectangular slot is aligned with one diagonal of the square, the other rectangular slot is aligned with the other diagonal of the square, and the junction of the two rectangular slots is coincident with the geometrical center of the square.

29 Claims, 6 Drawing Sheets

CIRCULARLY POLARIZED MICROSTRIP ANTENNAS

CROSS-REFERENCE TO RELATED PATENT APPLICATION

This application claims priority to and the benefit of, pursuant to 35 U.S.C. §119(e), U.S. provisional patent application Ser. No. 61/211,848, filed Apr. 3, 2009, entitled "Circularly Polarized Microstrip Antennas with Enhanced Gain Performance," by Rami Adada et al., and U.S. provisional patent application Ser. No. 61/214,681, filed Apr. 27, 2009, entitled "Circularly Polarized Microstrip Antennas with Enhanced Gain Performance," by Rami Adada et al., the disclosures of all which are incorporated herein in their entireties by reference.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references listed, cited, or discussed in this specification are incorporated herein by reference in their entireties and to the same extent as if each reference was individually incorporated by reference.

FIELD OF THE INVENTION

The present invention is generally related to an antenna, and more particularly to circularly polarized microstrip antennas with enhanced gain performance.

BACKGROUND OF THE INVENTION

Circularly polarized antennas emit electromagnetic waves comprised of two linearly polarized electric field components that are orthogonal, equal in magnitude and are 90 degrees out of phase. These antennas are desirable due to their ability to suppress a considerable portion of non line of sight signals as well as their resistance to polarization mismatch losses.

Traditional circularly polarized microstrip antennas have limited achievable boresight gain. This is usually increased by stacking either parasitic elements or high permittivity superstrates on top of the patch, which increases antenna height as well as fabrication complexity and cost. Another method traditionally employed to increase the directivity of microstrip antennas is the use of an array of such elements printed on the substrate. While effective, this technique suffers from increased complexity as well as cost, caused by the need to feed the separate array elements. The drawback of traditional circularly polarized microstrip antennas is their inability to provide uniform coverage especially at low elevation angles.

Another limitation of the traditional circularly polarized microstrip antennas is its limited beamwidth, and their ineffectiveness in radiating co-polarized fields below the antenna horizon. One example of the need for such characteristics is in marine GPS, where pitch and roll movement of the vessel may cause the GPS receiver to lose reception from some of the transmitting satellites.

Therefore, a heretofore unaddressed need exists in the art to address the aforementioned deficiencies and inadequacies.

SUMMARY OF THE INVENTION

One of the objectives of this invention is to provide a technique that allows for improved control over the gain performance of a single element circularly polarized microstrip antenna that does not require stacking or increasing fabrication complexity or cost of the microstrip antenna.

According to the invention, an antenna assembly comprises a square or almost square microstrip antenna operating at orthogonally higher order modes $TM_{0m}$ and $TM_{m0}$ with a 90 degrees phase shift between the two modes. In this higher order mode operation, the single patch behaves like an m×m array of circularly polarized antenna elements operating at the fundamental modes ($TM_{10}$ and $TM_{01}$). The elements of this virtual array which deliver a cross polarized signal as well as the elements delivering 180 degrees out of phase signal are detrimental to the high gain operation of the patch. By incorporating slots at the positions of these elements their effect can be minimized and the remaining elements operate as an array of co-polarized in-phase elements, thereby providing high gain. Furthermore, by pointing the different "array elements" of the patch in different directions, for example, using a flexible substrate, this type of antennas allows for control over its radiation pattern. Since a single patch is being used in this mode of operation, no additional feeding network is required and the same feeding schemes as for traditional single element circularly polarized microstrip antennas can be employed.

The present invention, among other things, provides a technique to increase the gain of a circularly polarized single element microstrip antenna, which has low profile and provides uniform hemispheric as well as below horizon coverage. This approach does not require an increase in thickness, fabrication complexity or cost of the antenna.

In one aspect of the invention, a circularly polarized antenna includes a dielectric substrate having a first surface and an opposite, second surface, a conductive ground layer formed on the first surface of the dielectric substrate, and a conductive patch formed in a square shape with four equal sides on the second surface of the dielectric substrate.

The conductive patch has four square slots and two rectangular slots. Each square slot is formed in the central portion of each side, and the two rectangular slots are orthogonally formed in the central area of the square such that one rectangular slot is aligned with one diagonal of the square, the other rectangular slot is aligned with the other diagonal of the square, and the junction of the two rectangular slots is coincident with the geometrical center of the square.

In one embodiment, the conductive square patch has a side length, $P_L$. Each square slot has a side length, $S_L$, where $S_L \leqq P_L/3$. Each rectangular slot has a side width, $R_W$, and a side length $R_L$, where $R_L > R_W$, and $R_L \leqq \sqrt{2}P_L/3$.

In one embodiment, the dielectric substrate is substantially square in shape, and has a side length, $D_L$, where $D_L > P_L$. The dielectric substrate has a thickness T defined between the first and second surface. The dielectric substrate may be formed with a dielectric material having a permittivity of about 2.2.

Additionally, the circularly polarized antenna also includes two signal feed ports formed on the conductive patch at a first location and a second location, respectively. The two signal feed ports are adapted for receiving two signals, where one signal is phase-shifted $+\pi/2$ from the other signal. In one embodiment, the first location is apart from the geometric center of the conductive patch by a predetermined distance in a first direction parallel to one side of the conductive patch, and the second location is apart from the geometric center of the conductive patch by the predetermined distance in a second direction perpendicular to the first direction.

In another aspect, the present invention relates to a circularly polarized antenna operable at orthogonal m-th order modes $TM_{0m}$ and $TM_{m0}$ with a 90 degrees phase shift between the two modes, m being a positive integer. In one embodiment, the circularly polarized antenna includes a conductive ground layer, a dielectric substrate formed on the conductive ground layer, and a conductive patch formed on the dielectric substrate, and characterized with an m×m array of circularly polarized antenna elements operating at the fundamental modes $TM_{01}$ and $TM_{10}$, the m×m array having a group of first elements operably delivering a plurality of co-polarized in-phase signals and a group of second elements operably delivering a plurality of cross-polarized out-phase signals, and one or more third elements operably delivering one or more polarized signals that are 180 degrees out of phase of the plurality of co-polarized in-phase signals, where the conductive patch has a plurality of slots, each slot formed in a corresponding element of the group of second elements and the one or more third elements, and one or more signal feed ports formed on the conductive patch.

In one embodiment, the conductive patch is formed in a square shape having a side length, $P_L$. The dielectric substrate is substantially square in shape, and has a side length, $D_L$, where $D_L>P_L$.

In one embodiment, the plurality of slots comprises a plurality of square slots and a plurality of rectangular slots, where each square slot is formed in a corresponding element of the group of second elements, and each pair of rectangular slots is orthogonally formed in corresponding element of the one or more third elements. In one embodiment, each square slot has a side length, $S_L$, where $S_L \leqq P_L/m$. Each rectangular slot has a side width, $R_W$, and a side length $R_L$, where $R_L>R_W$, and $R_L \leqq \sqrt{2}P_L/m$.

In one embodiment, the one or more signal feed ports comprises a first signal feed port formed at a first location of the conductive patch and a second signal feed port formed at a second location of the conductive patch. The first and second signal feed ports are adapted for receiving two signals, where one signal is phase-shifted $+\pi/2$ from the other signal. In one embodiment, the first location is apart from the geometric center of the conductive patch by a predetermined distance in a first direction parallel to one side of the conductive patch, and the second location is apart from the geometric center of the conductive patch by the predetermined distance in a second direction perpendicular to the first direction.

In yet another aspect, the present invention relates to a circularly polarized antenna operable at orthogonal m-th order modes $TM_{0m}$ and $TM_{m0}$ with a 90 degrees phase shift between the two modes, m being a positive integer. In one embodiment, the circularly polarized antenna includes a conductive patch characterized with an m×m array of antenna elements operating at the fundamental modes $TM_{01}$ and $TM_{10}$, the m×m array having a group of first elements operably delivering a plurality of co-polarized in-phase signals and a group of second elements operably delivering a plurality of cross-polarized out-phase signals, and one or more third elements operably delivering one or more polarized signals that are 180 degrees out of phase of the plurality of co-polarized in-phase signals, and means for minimizing the plurality of cross-polarized out-phase signals operably delivered from the group of second elements and the one or more polarized signals operably delivered from the one or more third elements.

In one embodiment, the conductive patch is formed in a square shape having a side length, $P_L$. In one embodiment, the minimizing means comprises a plurality of square slots and a plurality of rectangular slots, where each square slot is formed in a corresponding element of the group of second elements, and each pair of rectangular slots is orthogonally formed in corresponding element of the one or more third elements. Each square slot has a side length, $S_L$, where $S_L \leqq P_L/m$. Each rectangular slot has a side width, $R_W$, and a side length $R_L$, where $R_L>R_W$, and $R_L \leqq \sqrt{2}P_L/m$.

The circularly polarized antenna further includes a conductive ground layer and a dielectric substrate formed between the conductive ground layer and the conductive patch.

The circularly polarized antenna also includes one or more signal feed ports formed on the conductive patch. In one embodiment, the one or more signal feed ports comprises a first signal feed port formed at a first location of the conductive patch and a second signal feed port formed at a second location of the conductive patch. The first and second signal feed ports are adapted for receiving two signals, where one signal is phase-shifted $+\pi/2$ from the other signal.

In a further aspect, the present invention relates to a method for fabricating a circularly polarized microstrip antenna with enhancement of gain. In one embodiment, the method includes the steps of forming a microstrip antenna having a single conductive patch, characterizing the single conductive patch with an m×m array of antenna elements operating at the fundamental modes, where the m×m array has a group of first elements operably delivering a plurality of co-polarized in-phase signals and a group of second elements operably delivering a plurality of cross-polarized out-phase signals, and one or more third elements operably delivering one or more polarized signals that are 180 degrees out of phase of the plurality of co-polarized in-phase signals, and forming a plurality of slots with each slot in a corresponding element of the group of second elements and the one or more third elements so as to operably minimize the plurality of cross-polarized out-phase signals and the one or more polarized signals.

In one embodiment, the conductive patch is formed in a square shape having a side length, $P_L$.

In one embodiment, the plurality of slots comprises a plurality of square slots and a plurality of rectangular slots, where each square slot is formed in a corresponding element of the group of second elements, and each pair of rectangular slots is orthogonally formed in corresponding element of the one or more third elements. Each square slot has a side length, $S_L$, where $S_L \leqq P_L/m$. Each rectangular slot has a side width, $R_W$, and a side length $R_L$, where $R_L>R_W$, and $R_L \leqq \sqrt{2}P_L/m$.

The method further the step of forming one or more signal feed ports formed on the conductive patch.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
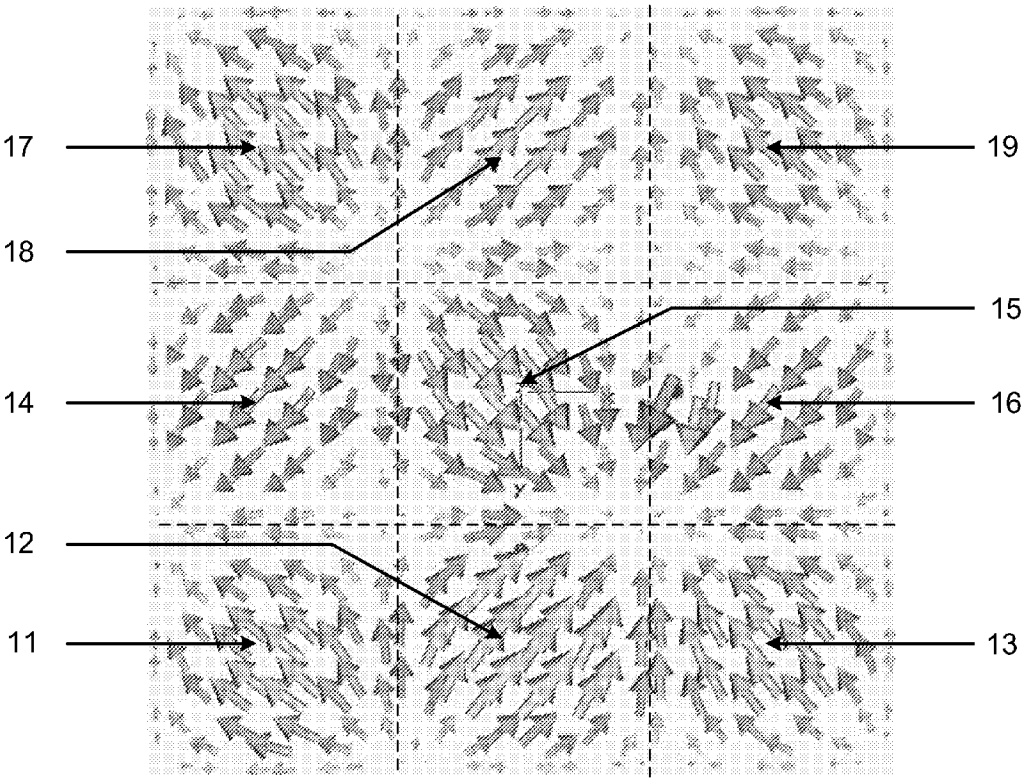
Fig. 1 (Prior Art)
FIG. 1 shows a current distribution of a traditional square patch antenna operating at $TM_{30}$ and $TM_{03}$ modes with $\pi/2$ phase shift between the two excited modes.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 1-5. In accordance with the purposes of this invention, as embodied and broadly described herein, this invention, in one aspect, relates to a circularly polarized microstrip antenna with enhanced gain performance.

An antenna assembly embodying the invention comprises a square or almost square microstrip antenna operating at orthogonally higher order modes $TM_{0m}$ and $TM_{m0}$ with a 90 degrees phase shift between the two modes. In this higher order mode operation, the single patch behaves like an m×m array of circularly polarized antenna elements operating at the fundamental modes ($TM_{10}$ and $TM_{01}$, where M is a non-zero integer). The elements of this virtual array which delivers a cross polarized signal as well as the elements delivering 180 degrees out of phase signal are detrimental to the high gain operation of the patch. By incorporating slots at the positions of these elements their effect can be minimized and the remaining elements operate as an array of co-polarized in-phase elements, thereby providing high gain. Furthermore, by pointing the different "array elements" of the patch in different directions (using a flexible substrate for example), the antenna allows for control over its radiation pattern. Since a single patch is being used in this mode of operation, no additional feeding network is required and the same feeding schemes as for traditional single element circularly polarized microstrip antennas can be employed.

Figure 3A:
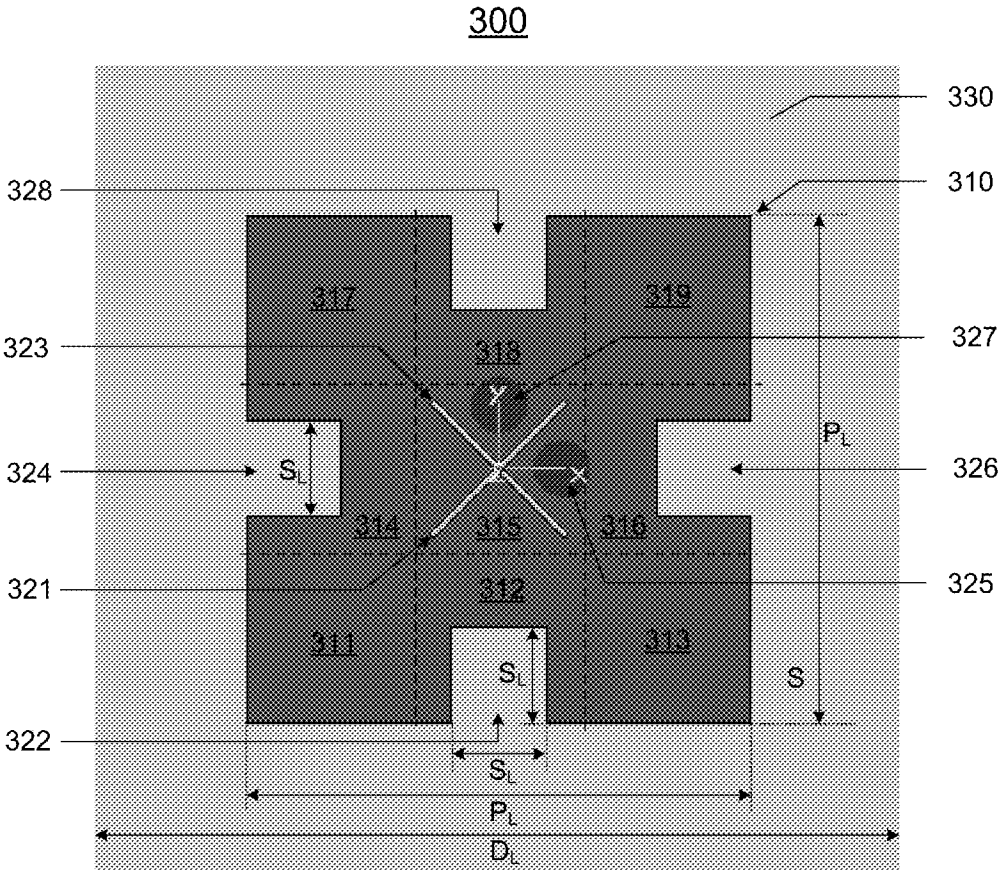
FIG. 3A is a top view of a microstrip patch antenna according to one embodiment of the present invention.
Figure 3B:
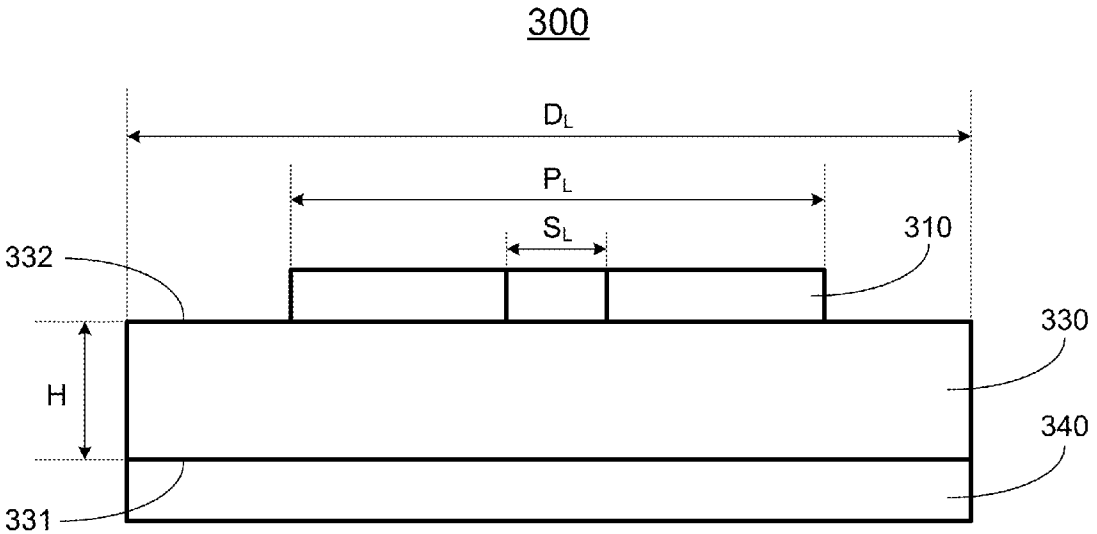
FIG. 3B is a side view of the microstrip patch antenna as shown in FIG. 3A.

Referring to FIGS. 3A and 3B, a circularly polarized antenna 300 is shown according to one embodiment of the invention. The circularly polarized antenna 300 includes a dielectric substrate 330 having a first surface 331 and an opposite, second surface 332, a conductive ground layer 340 formed on the first surface 331 of the dielectric substrate 330, and a conductive patch 310 formed on the second surface 332 of the dielectric substrate 330.

In this exemplary embodiment, the circularly polarized antenna 300 is operable at orthogonal third order modes $TM_{03}$ and $TM_{30}$ with a 90 degrees phase shift between the two modes. Preferably, the conductive patch 310 is substantially square in shape with four equal sides. The conductive patch 310 can be effectively characterized with a 3×3 array of circularly polarized antenna elements 311-319 operating at the fundamental modes $TM_{01}$ and $TM_{10}$. As shown below, elements 311, 313, 317 and 319 located at four corner portions are operably delivering co-polarized in-phase signals, elements 312, 314, 316 and 318 located between four corner portions are operably delivering cross-polarized out-phase signals, while element 315 located in the center of the array is operably delivering a polarized signal that is 180 degrees out of phase of the co-polarized in-phase signals.

To enhance the gain of the circularly polarized antenna 300, these cross-polarized out-phase signals and the polarized signal that is 180 degrees out of phase of the co-polarized in-phase signals should be substantially reduced or eliminated. This can be achieved by forming four square slots 322, 324, 326 and 328 and two rectangular slots 321 and 323 on the conductive patch 310. Specifically, each square slot 322, 324, 326 or 328 is formed in a corresponding element 312, 314, 316 and 318, respectively. In other words, a set of four inner corners of the conductive patch 310 defines a recess 322, 324, 326 or 328 at a center of a respective side of the conductive patch 310. The two rectangular slots 321 and 323 are orthogonally formed in the element 315, where one rectangular slot 321 or 323 is aligned with one diagonal of the conductive patch 310, while the other rectangular slot 323 or 321 is aligned with the other diagonal of the conductive patch 310. The junction of the two rectangular slots 321 and 323 is coincident with the geometrical center of the conductive patch 310.

The conductive square patch 310 has a side length, $P_L$. Thus, each element 311, 312, . . . or 319 is square in shape having a side length of $P_L/3$. Each square slot has a side length, $S_L \leqq P_L/3$. Each rectangular slot has a side width, $R_W$, and a side length $R_L$, where $R_L > R_W$, and $R_L \leqq \sqrt{2}P_L/3$.

The dielectric substrate is also square in shape, and has a side length, $D_L$, which $D_L > P_L$. The dielectric substrate has a thickness T defined between the first and second surface. The dielectric substrate may be formed with a dielectric material having a relative permittivity of about 2.2.

Additionally, the circularly polarized antenna 300 also includes two signal feed ports formed on the conductive patch 310 at a first location 325 and a second location 327, respectively. The two signal feed ports are adapted for receiving two signals, which one signal is phase-shifted $+\pi/2$ from the other signal. As shown in FIG. 3A, the first location 325 is apart from the geometric center of the conductive patch 310 by a distance in a first direction (x-axis) parallel to one side of the conductive patch 310, and the second location 327 is apart from the geometric center of the conductive patch 310 by the distance in a second direction (y-axis) perpendicular to the first direction.

In another aspect of the invention, a circularly polarized antenna operable at orthogonal m-th order modes $TM_{0m}$ and $TM_{m0}$ with a 90 degrees phase shift between the two modes includes a conductive ground layer, a dielectric substrate formed on the conductive ground layer, and a conductive patch formed on the dielectric substrate.

The conductive patch is virtually characterized with an m×m array of circularly polarized antenna elements operating at the fundamental modes $TM_{01}$ and $TM_{10}$. The m×m array has a group of first elements operably delivering a plurality of co-polarized in-phase signals and a group of second elements operably delivering a plurality of cross-polarized out-phase signals, and one or more third elements operably delivering one or more polarized signals that are 180 degrees out of phase of the plurality of co-polarized in-phase signals. To minimizing the effects of cross-polarized out-phase signals and one or more polarized signals that are 180 degrees out of phase of the plurality of co-polarized in-phase signals, a plurality of slots is formed in the conductive patch. Specifically, each slot formed in a corresponding element of the group of second elements and the one or more third elements, and one or more signal feed ports formed on the conductive patch.

In one embodiment, the conductive patch is formed in a square shape having a side length, $P_L$. The dielectric substrate is also square in shape, and has a side length, $D_L$, where $D_L > P_L$.

In one embodiment, the plurality of slots comprises a plurality of square slots and a plurality of rectangular slots, where each square slot is formed in a corresponding element of the group of second elements, and each pair of rectangular slots is orthogonally formed in corresponding element of the one or more third elements. In one embodiment, each square slot has a side length, $S_L$, where $S_L \leqq P_L/m$. Each rectangular slot has a side width, $R_W$, and a side length $R_L$, where $R_L > R_W$, and $R_L \leqq \sqrt{2}P_L/m$.

In one embodiment, the one or more signal feed ports comprises a first signal feed port formed at a first location of the conductive patch and a second signal feed port formed at a second location of the conductive patch. The first and second signal feed ports are adapted for receiving two signals, where one signal is phase-shifted $+\pi/2$ from the other signal. In one embodiment, the first location is apart from the geometric center of the conductive patch by a predetermined distance in a first direction parallel to one side of the conductive patch, and the second location is apart from the geometric center of the conductive patch by the predetermined distance in a second direction perpendicular to the first direction.

In yet another aspect of the present invention, a circularly polarized antenna operable at orthogonal m-th order modes $TM_{0m}$ and $TM_{m0}$ with a 90 degrees phase shift between the two modes includes a conductive patch characterized with an m×m array of antenna elements operating at the fundamental modes $TM_{01}$ and $TM_{10}$, the m×m array having a group of first elements operably delivering a plurality of co-polarized in-phase signals and a group of second elements operably delivering a plurality of cross-polarized out-phase signals, and one or more third elements operably delivering one or more polarized signals that are 180 degrees out of phase of the plurality of co-polarized in-phase signals, and means for minimizing the plurality of cross-polarized out-phase signals operably delivered from the group of second elements and the one or more polarized signals operably delivered from the one or more third elements.

In one embodiment, the conductive patch is formed in a square shape. In one embodiment, the minimizing means comprises a plurality of square slots and a plurality of rectangular slots, where each square slot is formed in a corresponding element of the group of second elements, and each pair of rectangular slots is orthogonally formed in corresponding element of the one or more third elements.

In a further aspect of the present invention, a method for fabricating a circularly polarized microstrip antenna with enhancement of gain includes the steps of forming a microstrip antenna having a single conductive patch, characterizing the single conductive patch with an m×m array of antenna elements operating at the fundamental modes, where the m×m array has a group of first elements operably delivering a plurality of co-polarized in-phase signals and a group of second elements operably delivering a plurality of cross-polarized out-phase signals, and one or more third elements operably delivering one or more polarized signals that are 180 degrees out of phase of the plurality of co-polarized in-phase signals, and forming a plurality of slots with each slot in a corresponding element of the group of second elements and the one or more third elements so as to operably minimize the plurality of cross-polarized out-phase signals and the one or more polarized signals.

In one embodiment, the conductive patch is formed in a square shape. The plurality of slots comprises a plurality of square slots and a plurality of rectangular slots, where each square slot is formed in a corresponding element of the group of second elements, and each pair of rectangular slots is orthogonally formed in corresponding element of the one or more third elements.

These and other aspects of the present invention are further described below. Without intent to limit the scope of the invention, exemplary devices and their related results according to the embodiments of the present invention are given as follows.

Figure 2:
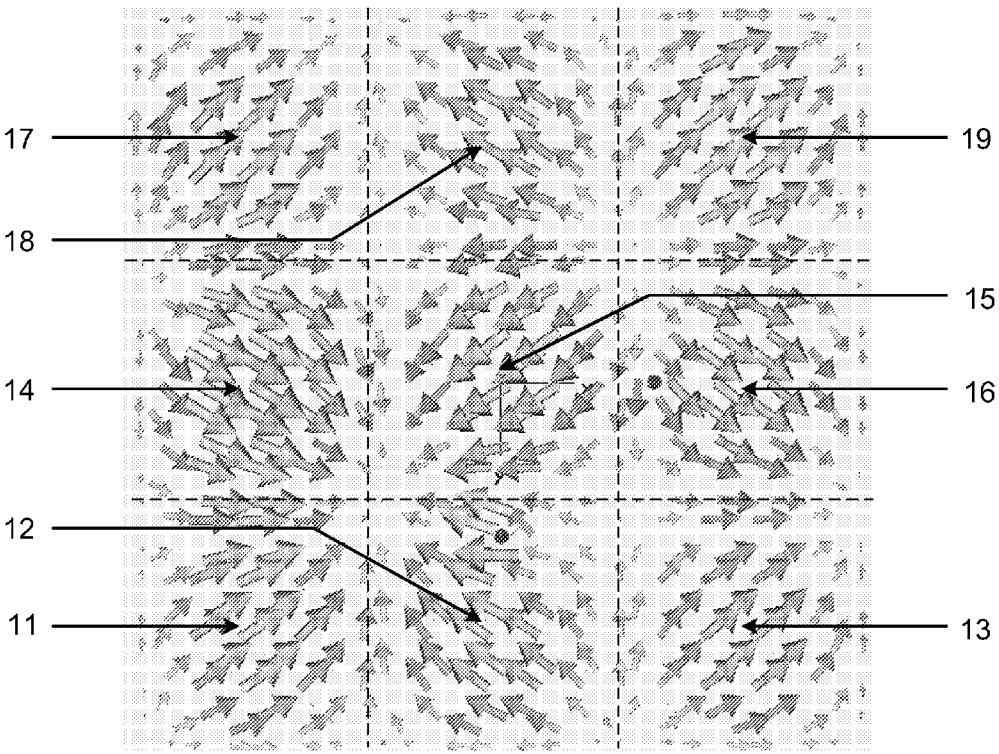
Fig. 2 (Prior Art)
FIG. 2 shows a current distribution of the square patch antenna shown in FIG. 1 with the phase shifted by $+\pi/2$.

A preferred embodiment of the invention utilizes a slot loaded square patch operating at the $TM_{30}$ and $TM_{03}$ modes with a 90 degrees phase shift between the two modes. FIG. 1 depicts the current distribution, indicated by arrows, along a traditional square patch at the $TM_{30}$ $TM_{03}$ mode of operation. It is clearly shown in FIG. 1 that the patch in this operation mode is behaving as a square 3×3 array of elements operating at the fundamental modes. FIG. 2 depicts the current distribution, indicated by arrows, along the same patch as shown in FIG. 1 with a phase shift of $+\pi/2$. It can be deduced from the directional change of the surface currents from FIG. 1 to FIG. 2 that the current distributions on parts/elements 11, 13, 15, 17 and 19 of the patch are rotating in one direction, while the current distributions on parts 12, 14, 16 and 18 of the patch are rotating in the opposite direction. It is also observed that the current distributions on parts 11, 13, 17 and 19 are in phase, while the current distribution on part 15 is about 180 degrees out of phase with the other parts of this group. Thus, parts 11, 13, 17 and 19 of the square patch operate as a 2×2 square array of co-polarized in-phase elements which provide a higher directivity (about 6 dB higher) than a square patch antenna operating at the fundamental mode. To take full advantage of this characteristic, the effect of parts 12, 14, 16 and 18 of the square patch, which act as cross-polarized elements as well as part 15, which acts as a 180 degrees out of phase element, should be minimized. According to the invention, minimizing the effect of these parts 12, 14, 16 and 18 of the square patch is attained by introducing slots of the appropriate size and shape in the patch at these locations.

Referring back to FIGS. 3A and 3B, a microstrip patch antenna 300 according to one embodiment of the invention is shown, which is designed and simulated using an FDTD (finite-difference time-domain) based commercial electromagnetic simulation software. The microstrip patch antenna 300 includes a single electrically conductive patch 310, an electrically conductive ground plane 340 and a dielectric substrate 330 formed between the single patch 310 and the ground plane 340.

Four square slots 322, 324, 326 and 328 are formed on the cross-polarized parts 312, 314, 316 and 318 of the patch. The side length $S_L$ of these square slots is about 30 mm. Two thin, orthogonal rectangular slots 321 and 323 are formed to minimize the effect of part 315 of the patch. Each of the rectangular slots 321 and 323 has a width $R_W$ about 2 mm and a length $R_L$ about 60 mm. The side length $P_L$ of the patch is about 160 mm. The patch 310 is printed on top of square slab/substrate 330 of dielectric material having a side length $D_L$=260 mm and a thickness H=4 mm. The relative permittivity of the dielectric substrate is 2.2. The other side of the substrate 330 is covered by a conductive layer 340 which constitutes the ground plane 340. The patch 310 is fed at first and second locations 325 and 327, one along the x-axis, the other along the y-axis, both displaced by about 12 mm from the center of the patch 310. The signal fed into the port at the first location 325 is phase-shifted by $+\pi/2$ with respect to the signal fed into the port at the second location 327. This results in the right hand polarization operation of the antenna 300.

Figure 4:
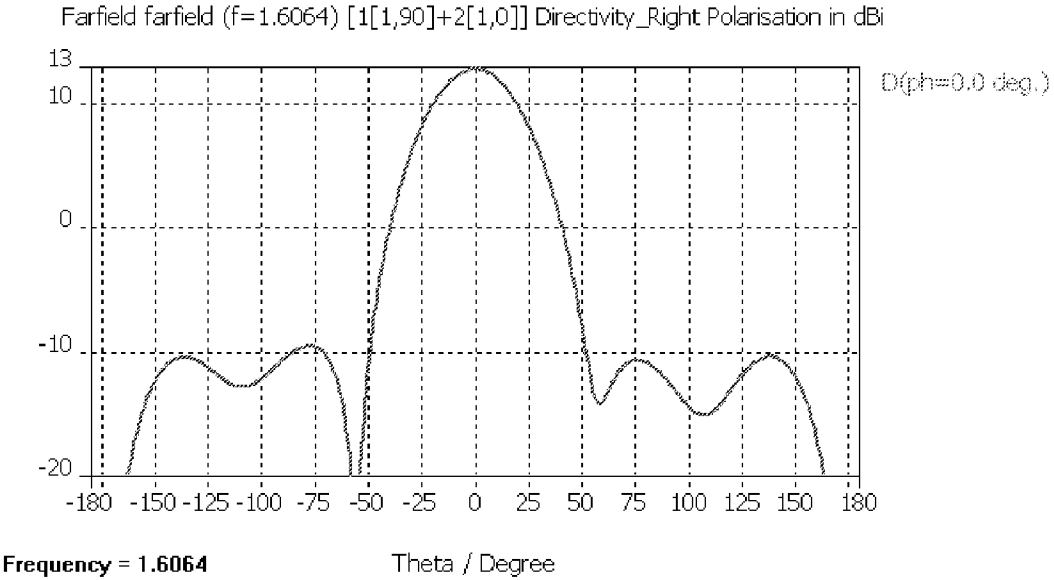
FIG. 4 is a graph illustrating the right-hand polarization directivity with respect to an isotropic source as a function of azimuth angle, of the microstrip patch antenna shown in FIGS. 3A and 3B.

FIG. 4 illustrates the right-hand polarization directivity of the antenna 300 simulated as a function of elevation angle. A maximum directivity of about 13 dB is achieved in the zenith at 1.6064 GHz. This is an increase of about 6 dB over a circularly polarized square microstrip antenna printed on the same sized substrate but operating at the fundamental modes.

Figure 5:
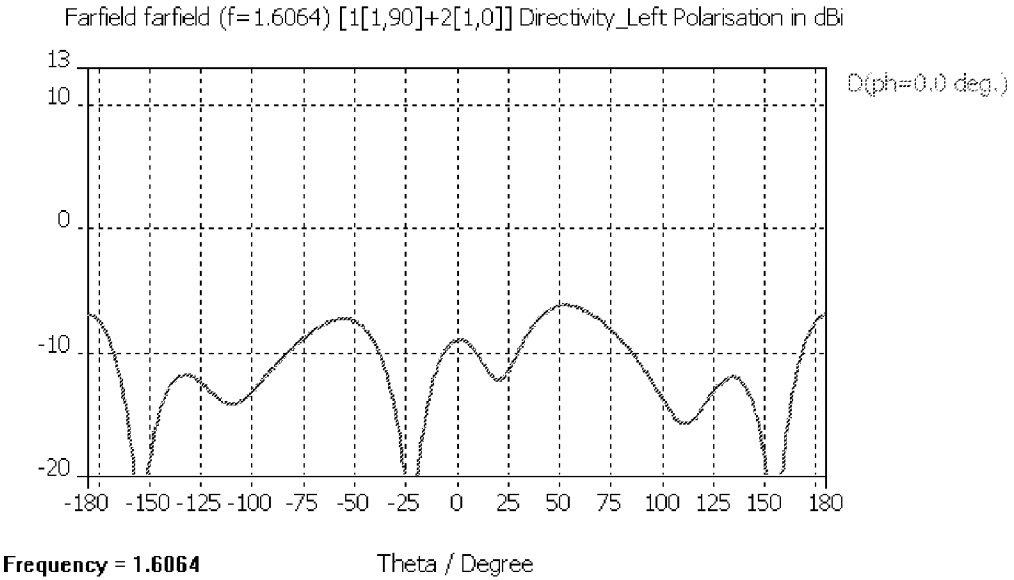
FIG. 5 is a graph illustrating the left-hand polarization directivity with respect to an isotropic source as a function of azimuth angle, of the microstrip patch antenna shown in FIGS. 3A and 3B.

FIG. 5 illustrates the cross polarization rejection capabilities, at the same frequency, of the simulated antenna as a function of elevation angle.

The present invention, among other things, provides a technique to increase the gain of a circularly polarized single element microstrip antenna. This technique does not require an increase in height, complexity of fabrication or cost of the microstrip antenna while providing a considerable gain increase. Using this technique, one is able to design a single element circularly polarized microstrip antenna with uniform hemispherical coverage as well as below horizon coverage.

The single element circularly polarized microstrip antennas according to the current invention offer many desirable characteristics including but not limited to, a low profile, mechanical ruggedness, conformability as well as low fabrication cost and complexity. The antennas of the present invention can find many applications in a wide spectrum of fields, for example, applications in wireless communication including, satellite based communication (Satellite Digital Audio Radio Services, GPS), WiMAX and WiFi, and RFID, and so on.

In the preferred embodiments disclosed above, the conductive patch is square in shape. It should be appreciated by people skilled in the art that other geometrical shapes of the conductive patch can also be utilized in practice of the present application.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. For example, multiple probes may be utilized at the same time to practice the present invention. Accordingly, the scope of the present invention is defined by the appended claims rather than the foregoing description and the exemplary embodiments described therein.

What is claimed is:

1. A circularly polarized antenna, comprising:

(a) a dielectric substrate having a first surface and an opposite, second surface;

(b) a conductive ground layer formed on the first surface of the dielectric substrate;

(c) a conductive patch on the second surface of the dielectric substrate, the conductive patch having four outermost corners and four sets of four inner corners, the conductive patch defining two rectangular slots, wherein the four outermost corners define a square surface that encompasses entirely a current distribution face of the conductive patch, the current distribution face delivering co-polarized in-phase signals and cross-polarized out-phase signals;

wherein each adjacent two of the outermost corners are contained in a respective side the conductive patch;

wherein each set of the sets of four inner corners defines a recess at a center of a respective one of the sides of the conductive patch, wherein the each set of four inner corners defines a square face of the recess on the square surface;

wherein each of the recesses is sized to substantially reduce the cross-polarized out-phase signals while the antenna is operating at a mode higher than the fundamental mode;

wherein the two rectangular slots are orthogonally formed in the central area of the square surface such that one rectangular slot is aligned with one diagonal of the square surface, the other rectangular slot is aligned with the other diagonal of the square surface, and the junction of the two rectangular slots is coincident with the geometrical center of the square surface; and (d) two signal feed ports formed on the conductive patch at a first location and a second location, respectively.

2. The circularly polarized antenna of claim 1, wherein the conductive patch has a side length, $P_L$.

3. The circularly polarized antenna of claim 2, wherein each square recess has a side length, $S_L$, wherein $S_L \leqq P_{L/3}$.

4. The circularly polarized antenna of claim 2, wherein each rectangular slot has a side width, $R_W$, and a side length $R_L$, wherein $R_L > R_W$, and $R_L \leqq \sqrt{2}P_{L/}3$.

5. The circularly polarized antenna of claim 2, wherein the dielectric substrate is substantially square in shape, and has a side length, $D_L$, wherein $D_L > P_L$.

6. The circularly polarized antenna of claim 1, wherein the dielectric substrate has a thickness T defined between the first and second surface.

7. The circularly polarized antenna of claim 1, wherein the dielectric substrate is formed with a dielectric material having a permittivity of about 2.2.

8. The circularly polarized antenna of claim 1, wherein the first location is apart from the geometric center of the conductive patch by a predetermined distance in a first direction parallel to one side of the conductive patch, and the second location is apart from the geometric center of the conductive patch by the predetermined distance in a second direction perpendicular to the first direction.

9. The circularly polarized antenna of claim 8, wherein the two signal feed ports are adapted for receiving two signals, wherein one signal is phase-shifted $+\pi/2$ from the other signal.

10. A circularly polarized antenna operable at orthogonal m-th order modes $TM_{0m}$ and $TM_{m0}$ with a 90 degrees phase shift between the two modes, m being an integer greater than 1, comprising:

(a) a conductive ground layer;

(b) a dielectric substrate formed on the conductive ground layer;

(c) a conductive patch formed on the dielectric substrate, the conductive patch having an m×m array of circularly polarized antenna elements configured to operate at the m-th order modes $TM_{0m}$ and $TM_{m0}$, the m×m array having a group of first elements configured to deliver a plurality of co-polarized in-phase signals and a group of second elements configured to deliver a plurality of cross-polarized out-phase signals, and one or more third elements configured to deliver one or more polarized signals that are 180 degrees out of phase of the plurality of co-polarized in-phase signals, wherein the conductive patch has four outermost corners and four sets of four inner corners;

wherein the four outermost corners define a square surface that encompasses entirely a current distribution face of the conductive patch, the current distribution face delivering the co-polarized in-phase signals and the cross-polarized out-phase signals;

wherein each adjacent two of the outermost corners are contained in a respective side the conductive patch;

wherein each set of the sets of four inner corners defines a recess in the second elements and at a center of a respective one of the sides of the conductive patch, wherein the each set of four inner corners defines a square face of the recess on the square surface;

wherein each of the recesses has a predetermined size such that the cross-polarized out-phase signals delivered by the corresponding second element are substantially reduced while the antenna is operating at the m-th order modes $TM_{0m}$ and $TM_{m0}$;

wherein the conductive patch has at least one slot formed in each of the one or more third elements; and wherein a pair of rectangular slots are orthogonally formed in the one or more third elements; and (d) one or more signal feed ports formed on the conductive patch.

11. The circularly polarized antenna of claim 10, wherein the conductive patch has a side length, $P_L$.

12. The circularly polarized antenna of claim 11, wherein the dielectric substrate is substantially square in shape, and has a side length, $D_L$, wherein $D_L > P_L$.

13. The circularly polarized antenna of claim 11, wherein each recess has a side length, $S_L$, wherein $S_L \leqq P_L/m$.

14. The circularly polarized antenna of claim 11, wherein each rectangular slot has a side width, $R_W$, and a side length $R_L$, wherein $R_L > R_W$, and $R_L \leqq \sqrt{2}P_L/m$.

15. The circularly polarized antenna of claim 11, wherein the one or more signal feed ports comprises a first signal feed port formed at a first location of the conductive patch and a second signal feed port formed at a second location of the conductive patch.

16. The circularly polarized antenna of claim 15, wherein the first location is apart from the geometric center of the conductive patch by a predetermined distance in a first direction parallel to one side of the conductive patch, and the second location is apart from the geometric center of the conductive patch by the predetermined distance in a second direction perpendicular to the first direction.

17. The circularly polarized antenna of claim 16, wherein the first and second signal feed ports are adapted for receiving two signals, wherein one signal is phase-shifted $+\pi/2$ from the other signal.

18. A circularly polarized antenna operable at orthogonal m-th order modes $TM_{0m}$ and $TM_{m0}$ with a 90 degrees phase shift between the two modes, m being an integer greater than 1, comprising:

(a) a conductive patch characterized with an m×m array of antenna elements configured to operate at the m-th order modes $TM_{0m}$ and $TM_{m0}$, the m×m array having a group of first elements configured to deliver a plurality of co-polarized in-phase signals and a group of second elements configured to deliver a plurality of cross-polarized out-phase signals, and one or more third elements configured to deliver one or more polarized signals that are 180 degrees out of phase of the plurality of co-polarized in-phase signals, wherein the conductive patch has four outermost corners and four sets of four inner corners;

wherein the four outermost corners define a square surface that encompasses entirely a current distribution face of the conductive patch, the current distribution face delivering the co-polarized in-phase signals and the cross-polarized out-phase signals;

wherein each adjacent two of the outermost corners are contained in a respective side the conductive patch;

(b) means for minimizing the plurality of cross-polarized out-phase signals delivered from the group of second elements while the antenna is operating at the m-th order modes $TM_{0m}$ and $TM_{m0}$, including each respective recess defined by each set of the sets of four inner corners in the second elements and at a center of a respective one of the sides of the conductive patch, wherein the each set of four inner corners defines a square face of the each recess on the square surface; and (c) means for minimizing the one or more polarized signals operably delivered from the one or more third elements while the antenna is operating at the m-th order modes $TM_{0m}$ and $TM_{m0}$, including a pair of rectangular slots orthogonally formed in the one or more third elements.

19. The circularly polarized antenna of claim 18, wherein the conductive patch has a side length, $P_L$.

20. The circularly polarized antenna of claim 19, wherein each recess has a side length, $S_L$, wherein $S_L \leqq P_L/m$.

21. The circularly polarized antenna of claim 19, wherein each rectangular slot has a side width, $R_W$, and a side length $R_L$, wherein $R_L > R_W$, and $R_L \leqq \sqrt{2}P_L/m$.

22. The circularly polarized antenna of claim 18, further comprising:

(a) a conductive ground layer;

(b) a dielectric substrate formed between the conductive ground layer and the conductive patch; and (c) one or more signal feed ports formed on the conductive patch.

23. The circularly polarized antenna of claim 22, wherein the one or more signal feed ports comprises a first signal feed port formed at a first location of the conductive patch and a second signal feed port formed at a second location of the conductive patch.

24. The circularly polarized antenna of claim 23, wherein the first and second signal feed ports are adapted for receiving two signals, wherein one signal is phase-shifted $+\pi/2$ from the other signal.

25. A method for fabricating a circularly polarized microstrip antenna with enhancement of gain, comprising:

forming a microstrip antenna having a single conductive patch, wherein the single conductive patch has an m×m array of antenna elements configured to operate at orthogonal m-th order modes $TM_{0m}$ and $TM_{m0}$, m being an integer greater than 1;

wherein the m×m array has a group of first elements operably delivering a plurality of co-polarized in-phase signals and a group of second elements operably delivering a plurality of cross-polarized out-phase signals, and one or more third elements operably delivering one or more polarized signals that are 180 degrees out of phase of the plurality of co-polarized in-phase signals;

wherein the conductive patch has four outermost corners and four sets of four inner corners;

wherein the four outermost corners define a square surface that encompasses entirely a current distribution face of the conductive patch, the current distribution face delivering the co-polarized in-phase signals and the cross-polarized out-phase signals;

wherein each adjacent two of the outermost corners are contained in a respective side the conductive patch;

wherein each set of the sets of four inner corners defines a recess at a center of a respective one of the sides of the conductive patch, wherein the each set of four inner corners defines a square surface of the recess on the square surface; and forming a recess in the second elements and at a center of a respective one of the sides of the conductive patch, wherein the each set of four inner corners defines a square face of the recess on the square surface, wherein each of the recesses has a predetermined size such that the plurality of cross-polarized out-phase signals are minimized while the antenna is operating at the orthogonal m-th order modes $TM_{0m}$ and $TM_{m0}$;

forming a pair of rectangular slots orthogonally in the one or more third elements.

26. The method of claim 25, wherein the conductive patch has a side length, $P_L$.

27. The method of claim 26, wherein each recess has a side length, $S_L$, wherein $S_L \leqq P_L/m$.

28. The method of claim 26, wherein each rectangular slot has a side width, $R_W$, and a side length $R_L$, wherein $R_L > R_W$, and $R_L \leqq \sqrt{2}P_L/m$.

29. The method of claim 25, further comprising the step of forming one or more signal feed ports formed on the conductive patch.

* * * * *